US008186855B2

(12) United States Patent
Wassel et al.

(10) Patent No.: US 8,186,855 B2
(45) Date of Patent: May 29, 2012

(54) LED LAMP APPARATUS AND METHOD OF MAKING AN LED LAMP APPARATUS

(76) Inventors: James J. Wassel, Fombell, PA (US); R. Douglas Falk, Fombell, PA (US)

( * ) Notice: Subject to any disclaimer, the term of this patent is extended or adjusted under 35 U.S.C. 154(b) by 0 days.

(21) Appl. No.: 12/243,316

(22) Filed: Oct. 1, 2008

(65) Prior Publication Data

US 2010/0254132 A1 Oct. 7, 2010

Related U.S. Application Data

(60) Provisional application No. 61/071,828, filed on May 20, 2008, provisional application No. 60/960,473, filed on Oct. 1, 2007.

(51) Int. Cl.
*F21V 29/00* (2006.01)

(52) U.S. Cl. ... 362/373; 362/294; 362/218; 362/249.02; 362/375

(58) Field of Classification Search ..... 362/218, 362/219, 221–223, 225, 217.05–217.07, 362/240, 241, 247, 249.02, 249.06, 294, 362/298, 300, 345–347, 364, 365, 373–375
See application file for complete search history.

(56) References Cited

U.S. PATENT DOCUMENTS

| | | | | |
|---|---|---|---|---|
| 7,144,135 | B2 * | 12/2006 | Martin et al. | 362/294 |
| 7,150,553 | B2 * | 12/2006 | English et al. | 362/545 |
| 7,158,019 | B2 * | 1/2007 | Smith | 340/467 |
| 7,625,103 | B2 * | 12/2009 | Villard | 362/294 |
| 2006/0001384 | A1 * | 1/2006 | Tain et al. | 315/246 |
| 2007/0091591 | A1 * | 4/2007 | Shamshoian | 362/147 |
| 2007/0228289 | A1 * | 10/2007 | Kaszuba et al. | 250/492.1 |

* cited by examiner

*Primary Examiner* — Thomas Sember
(74) *Attorney, Agent, or Firm* — Arent Fox LLP

(57) ABSTRACT

A device for illuminating a space comprising is discussed. In one variation, the device includes: a central body portion, with a length and a width, and including two plates running along the length of the central body portion wherein the two plates are separated by a spacer; an opening for the removal of heat during operation of the device that extends along a portion of the length of the central body portion, a light emitting diode on the central body portion; a reflector, extending from the central body portion, for reflecting light emitted by the light emitting diode towards the illuminated space. Other variations are also discussed as are methods for using suitable variations for retrofitting existing non-light emitting diode light sources.

20 Claims, 17 Drawing Sheets

LED LAMP APPARATUS AND METHOD OF MAKING AN LED LAMP APPARATUS

This application claims priority to Applicant's U.S. Provisional Patent Appl. No. 61/071,828 titled "LED lamp apparatus and method of making an LED lamp apparatus" filed May 20, 2008 and U.S. Provisional Patent Appl. No. 60/960,473 titled "LED light apparatus" filed Oct. 1, 2007

BACKGROUND OF THE INVENTION

1. Field of the Invention

Aspects of the present invention relate to a light emitting diode (LED) or other solid state light emitter light device.

2. Background of the Technology

In the past, the use of incandescent and halogen bulbs has been problematic in a number of ways. First, incandescent light bulbs are very energy-inefficient. A large percentage of the energy they consume is released as heat, rather than light. Although fluorescent bulbs are more efficient than incandescent light bulbs, they are still very inefficient when compared to light emitting diodes (LEDs) or other similar solid state light emitters.

Second, incandescent and fluorescent light bulbs have short lifetimes when compared to solid state emitters. This limitation requires lighting devices to be replaced more frequently. A short lifetime becomes even more problematic when used in overhead lighting in large buildings or in other areas where access may be difficult, such as vaulted ceilings, bridges, areas with significant traffic, and other hard to reach areas. Replacement is not only time consuming, but can be dangerous.

Third, the unwanted heat produced in these lighting systems adds not only to additional energy costs, but may also require additional air conditioning to lower the temperature of the area lit by the system. For example, in large buildings, overhead lighting is often provided by lights placed near the ceiling and directed downward. These building will require additional air conditioning to compensate for this energy produced as heat.

Fourth, previous lamp designs, such as those including a housing with a flat plate and having a light bulb socket in the flat plate, problematically collected water and dirt and trapped insects that are attracted to the light source. Each of these could cause electrical shorts and other problems that prevent the lamps from working correctly.

Large buildings often use metal halide lighting, which produces an undesirable amount of heat and noise. In addition, these lights periodically explode, sometimes dangerously emitting glass shards overhead of workers.

Although solid state emitters, such as LEDs, are known to be more energy efficient in general, LEDs have not been considered an option in the past for providing quality light in many applications because they do not provide enough useful light at a distance.

Therefore, there is a need in the art for methods and an apparatuses that can be used with LEDs or other solid state emitters to provide quality light from a distance. There is also need for a lamp designs that prevent the collection of water, dirt, or insects, that can be used to replace or retrofit current lamp models, as well as a method of efficiently making such lamps and/or retrofitting existing lamps.

SUMMARY OF THE INVENTION

Aspects of the present invention overcome the above identified problems, as well as others, by providing an LED or other solid state light apparatus (herein after also interchangeably referred to as an "LED device") that directs enough light from a plurality of LEDs to a distant area in a form that provides an acceptable amount of light, by providing a design that can be used to retrofit and/or replace current lamp models, by providing a lamp design that prevents the collection of water, dirt, and insects, and/or by providing an efficient method of making such lamps.

A variation of the present invention includes a device with a central chimney portion formed by two flat, rectangular side pieces that are spaced apart by at least two spacers. A reflector is attached to each side piece, and a plurality of LEDs are attached to each side piece, such that the light emitting portion of the LED faces the reflector. The reflector directs light emitted from each LEDs in the direction of the desired area. The design, including the central chimney, cools the area of the LEDs and extends their lifetime.

In certain variations, the reflector piece may include a plurality of facets.

Additional aspects of the present invention include a device with a circular housing, a circular LED plate configured to fit within an opening of the housing and including a plurality of LEDs, an opening between the LED plate and the housing, and an attachment piece that attaches the LED plate to the housing.

In certain variations, the LED plate may include a plurality of slots.

In certain variations, the LED plate may include a rolled edge. This rolled edge may be continuous and may include a plurality of slots.

In certain variations, the LED plate may include a cover plate configured to surround the plurality of LEDS.

In certain variations, the lamp may further include a plurality of fins located inside the housing, behind the LED plate.

The plurality of LEDs may be configured in a plurality of designs, such as a rounded or linear pattern, and may come pre-attached to a single LED piece.

Additional advantages and novel features of aspects of the present invention will be set forth in part in the description that follows, and in part will become more apparent to those skilled in the art upon examination of the following or upon learning by practice thereof.

DETAILED DESCRIPTION

Variations of the present invention includes an LED or other solid state emitter light device or Plasma Emitters capable of providing useful light directed to a desired area.

Figure 1:
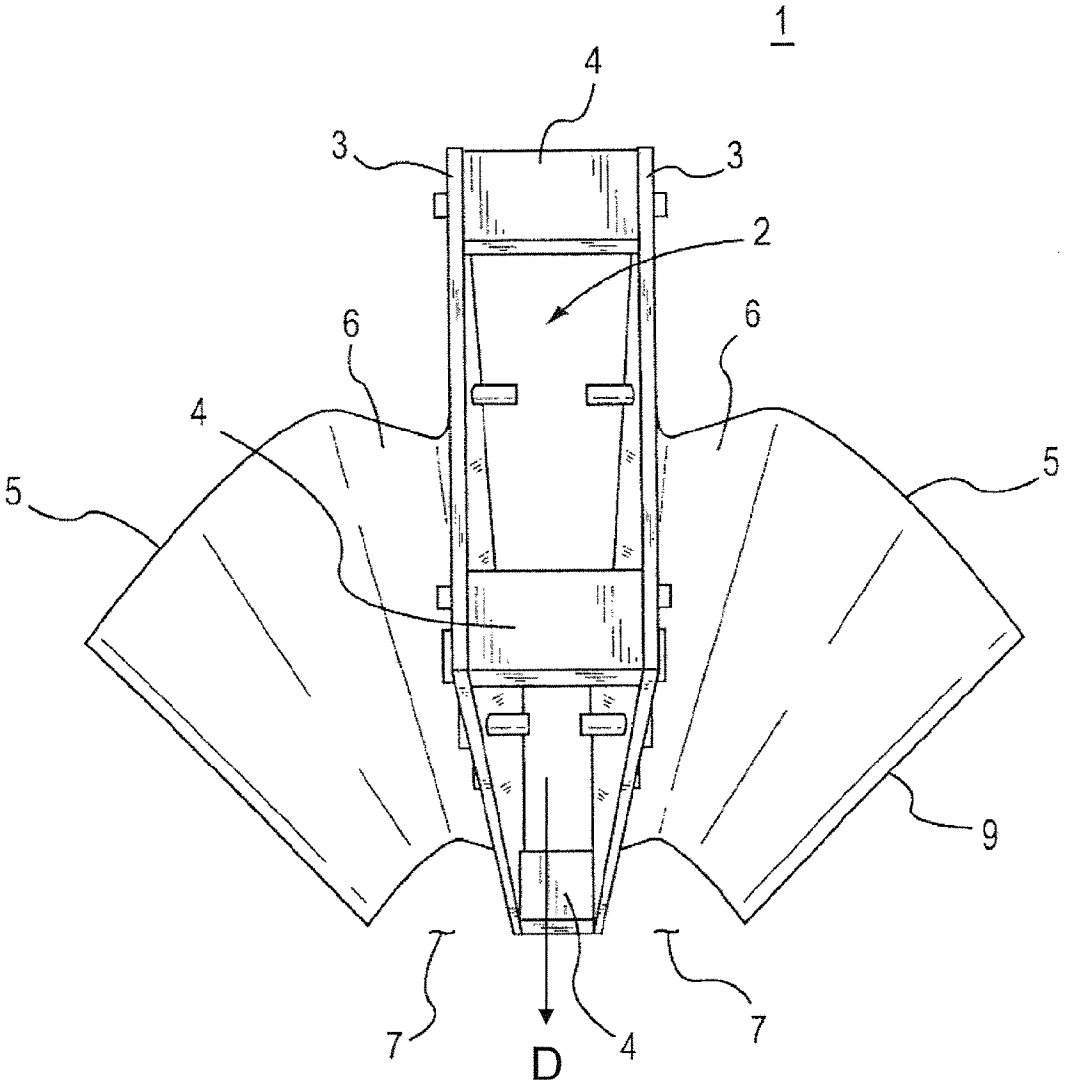
FIG. 1 shows a lighting device having a rolled reflector according to an exemplary variation of the present invention.

One exemplary variation of the 3 is shown in FIG. 1. Other views of this variation are shown in FIGS. 2-5. This variation includes a central chimney portion 2 formed by two chimney side plates 3. The chimney side plates 3 are connected together via at least two spacers 4. Direction D, an illumination direction, in FIG. 1 shows the direction between the device 1 and the illuminated space. The illumination direction is the direction in which light is directed from the device 1.

Figure 2:
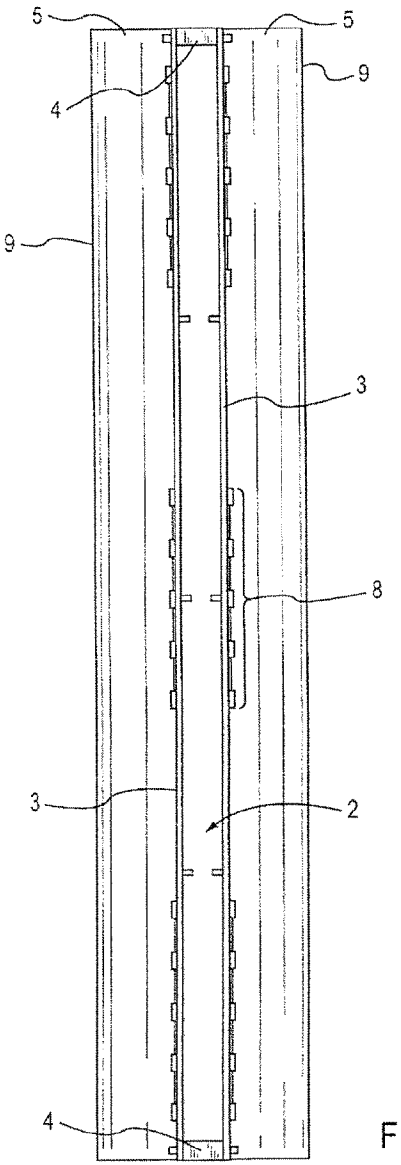
FIG. 2 shows a lower view of an exemplary variation of the present invention.
Figure 3:
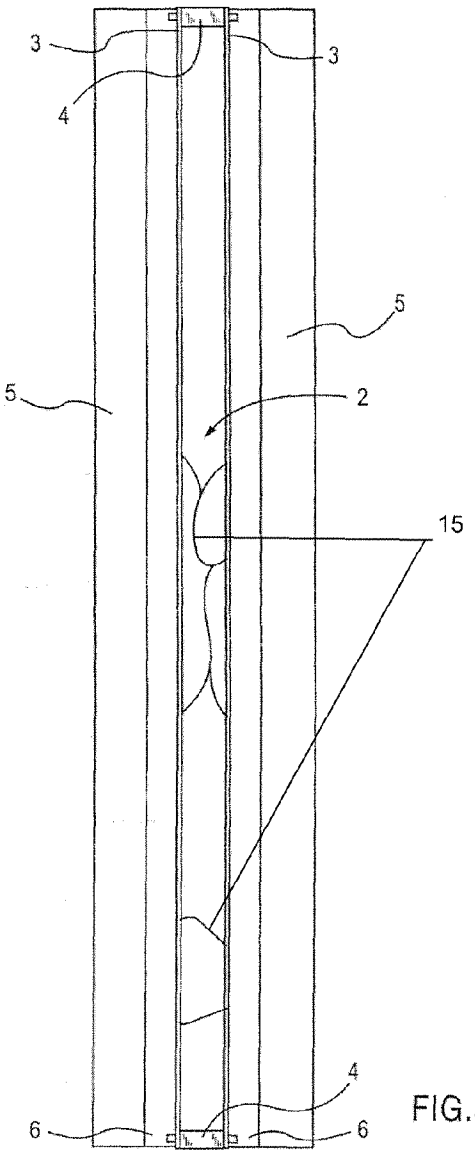
FIG. 3 shows an upper view of an exemplary variation of the present invention.

The variation in FIG. 1 shows four spacers. Thus, the chimney side plates 3 are spaced apart by an opening approximately equal to the size of the spacer 4. A plurality of LEDs 8 are mounted through each chimney side plate 3. (See, especially, FIG. 2). However, any suitable number of LEDs may be so mounted. Each of the LEDs of the light emitting portion of the LED faces a reflector 5, such that the direction of maximum intensity light emitted by the LEDs is substantially anti-parallel with the direction, D, separating the device 1 and the illuminated space. In other words, FIG. 1 is a device in which the LEDs may be oriented outwardly from the chimney side plates 3. As illustrated in FIG. 2, the LEDs 8 may be oriented perpendicular to the illumination direction D. This orientation maximizes the intensity of light provided by the LEDs to the reflector 5. Alternatively, the LEDs of the device 1 may have one of a number of other suitable orientations depending on the desired lighting effect and on the orientation of the reflector 5.

Figure 5:
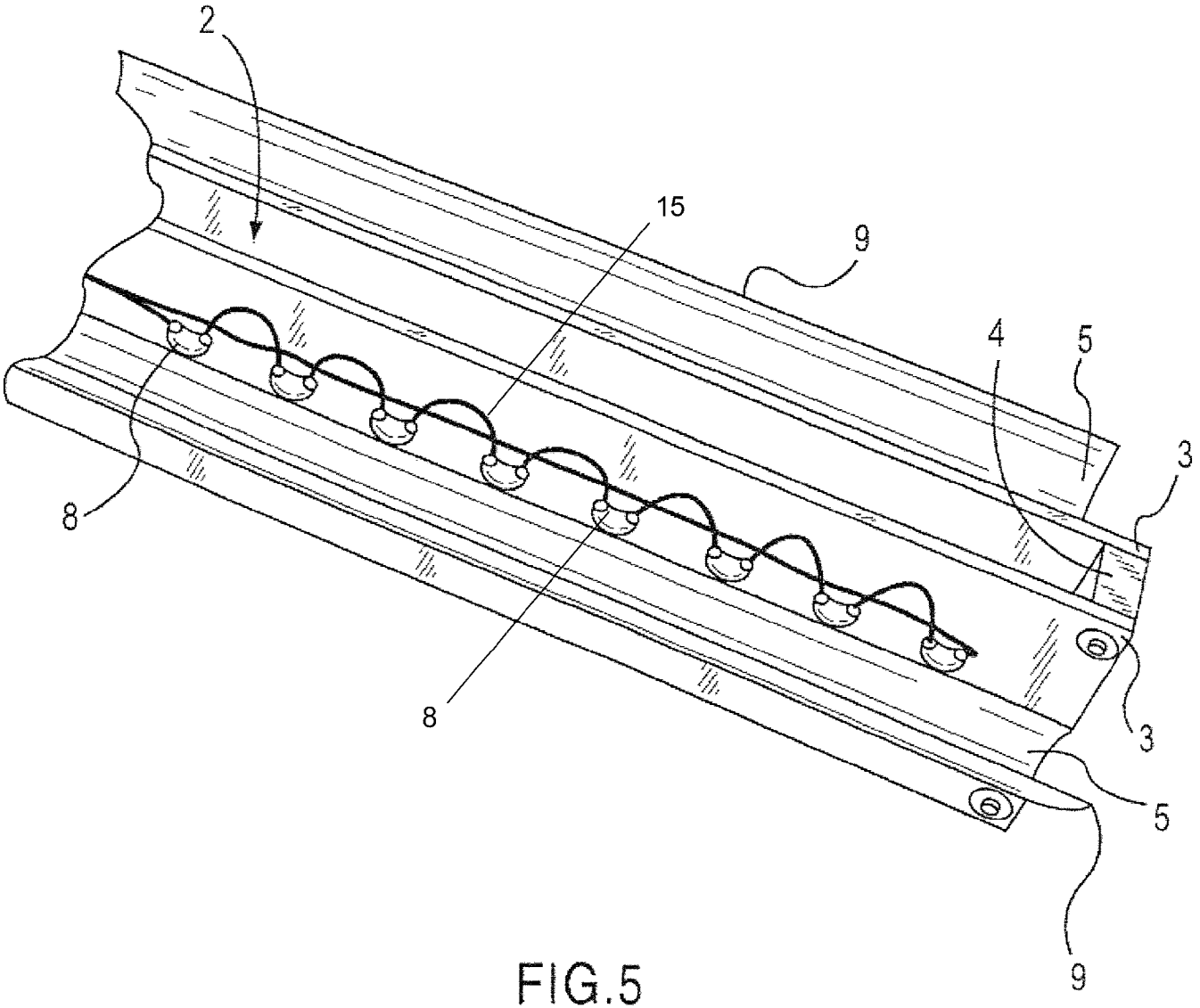
FIG. 5 shows a view of an exemplary variation of the present invention.

The wiring portion 15 of the LED protrudes through the chimney side plate 3 to the central opening 2. This wiring portion 15 is shown more explicitly in FIG. 3. As shown in FIG. 5, there may also be wiring 15 outside of the central opening 2 connecting the LEDs 8. The LEDs may be provided through various other configurations such as a strip. The LEDs may be provided in arrays, as shown in FIG. 2, or they may be provided in other configurations, such as that shown in FIG. 5. Any suitable LED arrangement may be used in any of the variations discussed herein. A reflector 5 may be attached to each chimney side plate 3, as shown in FIGS. 1 and 5. Each LED is mounted sideways so that the light emitting portion of each LED faces the reflector 5 and not the open section 7 between the far edge of the reflector and the portion of the chimney side piece 3 away from the attachment of the reflector. This is shown most explicitly in FIG. 2. However, any suitable orientation of the LEDs 8 is possible.

Figure 4:
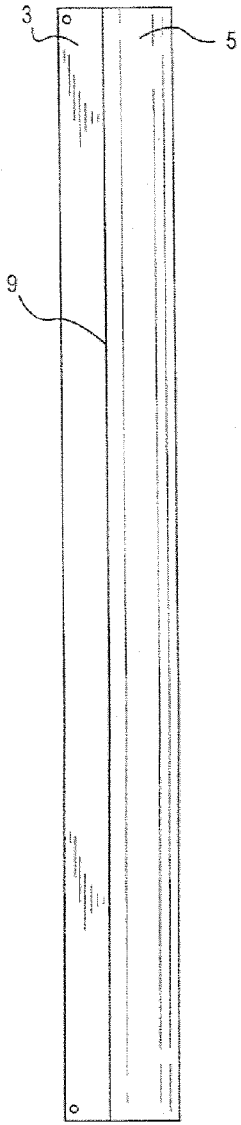
FIG. 4 shows side view of an exemplary variation of the present invention.

For example, in one exemplary application, the plurality of LEDs 8 may be mounted about 2.5 inches from the bottom of each chimney side piece, as shown in FIG. 5. However, the LEDs may also be mounted at any suitable portion of the chimney side piece. The reflector 5 may be attached to the chimney side piece near the top portion of the side piece, as best shown in FIGS. 4 and 5. Further, the LEDs may be mounted sideways rather than upward or downward. The LEDs may be mounted such that the light is emitting at an angle approximately 90 degrees from the desired area. Light from the LEDs is directed toward the bottom of the device by the reflector, so that light is directed toward the opening 7 between the bottom of the chimney side piece 3 and the far edge 9 of the reflector 5. The LEDs may be mounted in groups of eight, or different amounts as suitable for a particular application, with each LED spaced approximately between 1-2 inches from adjacent LEDs in the group. Alternatively, other suitable spacing between the LEDs may be used. A plurality of such groupings may be used in each side of the device. For example, the device may be configured as an approximately 45¼ inch by 9.5 inch rectangular shape. In this variation, each side may include two groups of eight LEDs, for a total of 32 LEDs.

Various variations of the reflector 5 may be used in the present invention. For example, as shown in FIGS. 1 and 5, the reflector may be rolled. The roll may include a continuous curve of about 90 degrees, though any suitably rolled reflector may be used. The continuously curved reflector provides more dispersed light. The continuously curved reflector may be suitable when the device is used at distances of approximately 10 feet or less. Alternatively, the continuously curved reflector may be suitable when the device is used at distances greater than 10 feet.

In an exemplary variation, as shown in FIGS. 1-5, the reflectors may be provided on the chimney portion above the LEDs. In an alternate variation, the reflectors may be provided directly on top of the LEDs. In the latter variation, openings will be provided in the reflector for each of the LEDs and slots will be cut into the top of the reflector to further relieve the heat from the LEDs. Fish paper may be provided between the reflector and the LED board to prevent shorting problems.

Figure 6:
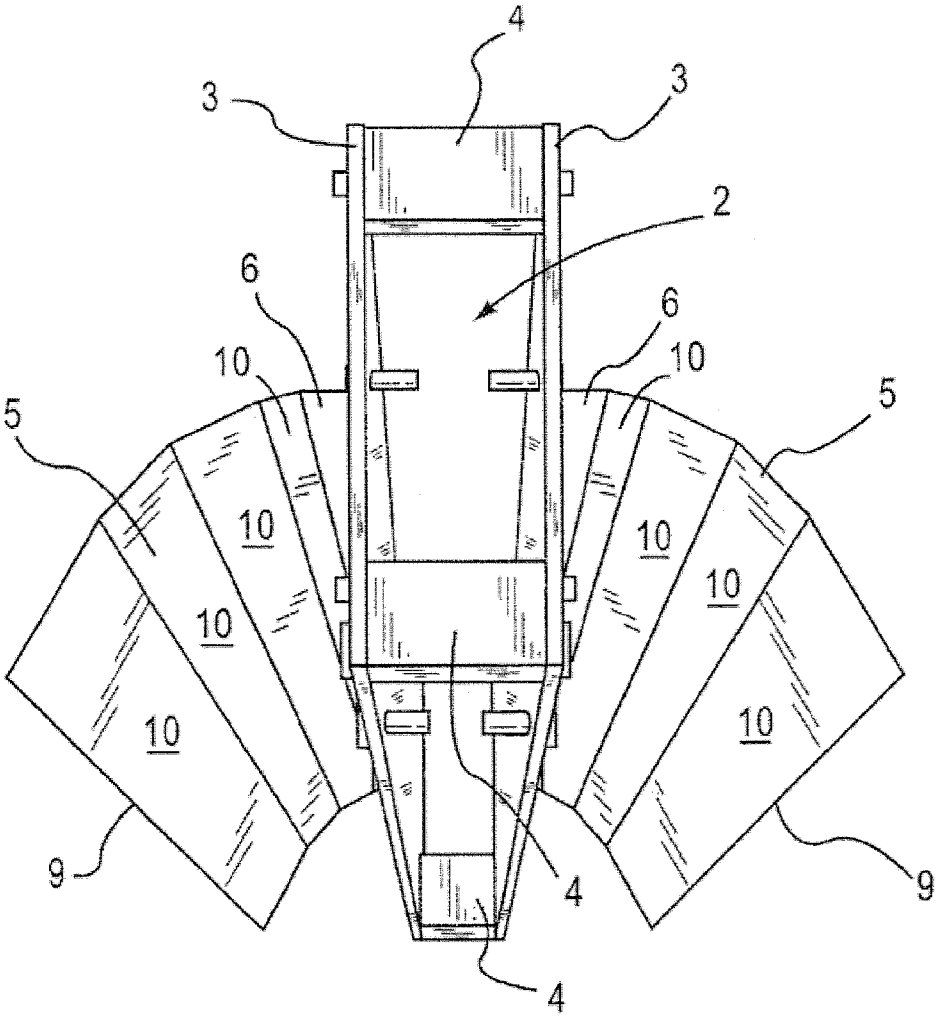
FIG. 6 shows a lighting device having a faceted reflector according to an exemplary variation of the present invention.

In another variation, the reflector may include a plurality of angles and facets 10. One example of this variation is shown in FIG. 6. In one variation, the reflector includes less than twelve facets. In another variation, the reflector includes between three and eight facets. However, any suitable number of facets may be used. For example, the reflector may include three facets. FIG. 6 shows a variation having four facets 10. When the device is used to illuminate objects at greater distances, facets direct can more of the light from the plurality of LEDs to a desired area. For example, the facets may improve the quality of light at the desired area at a distance of above 10 feet (e.g., about 20-40 feet) from the device.

The reflectors may lower the amount of dispersion of emitted light by directing it to a desired area. Thus, the continuously curved reflector, for example, may reduce the amount of dispersion that would occur if an LED were merely pointed in the direction of the desired area. The faceted reflector may reduce the amount of dispersion by an even greater amount. For example, at a distance of about 20 feet, a reflector including a plurality of facets provides a beam of light of approximately 8 feet by 30 feet. At this distance, the output can be about 35 foot candles.

Each reflector may include a flat portion 6 adjacent to the chimney side piece, as shown in FIG. 6. This flat portion may extend the reflector away from the LEDs mounted in the chimney side piece.

In some variations, each reflector is configured such that the reflector may be moved independently and adjusted relative to the chimney side piece. This allows the reflector to be adjusted such that the light from the LED is directed to a particular section of the reflector. For example, in one variation, the reflector is positioned so that most of the ideal LED light is directed toward a facet, rather than an angle.

LEDs may emit a pattern of light over about a 140 degree angle. Of this 140 degree range, about 80 degrees is typically of ideally useful light. In variations of the present invention, the light emitting portion of the LED may face the most inner facets of the reflector, such that the approximately 80 degrees of ideal light is directed to the first few facets. Such an orientation may substantially improve the efficiency and illumination power of the device.

The number of facets and the angles between pairs of facets is variable and may be determined based on the distance of the device from the desired area. For example, if the device will be used in a warehouse having a 20 foot ceiling, each reflector may include between 4-8 facets.

The reflector in any of the variations discussed herein need not be completely reflective. For example, an aluminum material without any further reflective layer may be used. Any suitably reflective material or material with an added reflective layer may also be used. For example, the reflector may be made of aluminum with an added layer. In addition aluminum with a silver coating may be used. The materials are not limited to aluminum or other metals, but may also include plastics and other similar materials with a polished or chrome finish, or other reflective surfaces. In addition, partially transparent and partially reflective materials may be used. Any suitably reflective material may be used for the reflectors.

Variations of the present invention may provide light with lower power consumption than typical metal halide lights. Metal halide lights use about 465 watts of energy. In contrast, an exemplary variation of the present invention uses less than 100 watts, typically about 74 watts, while outputting the same amount, if not more, light than the typical metal halide lamp.

Figure 7:
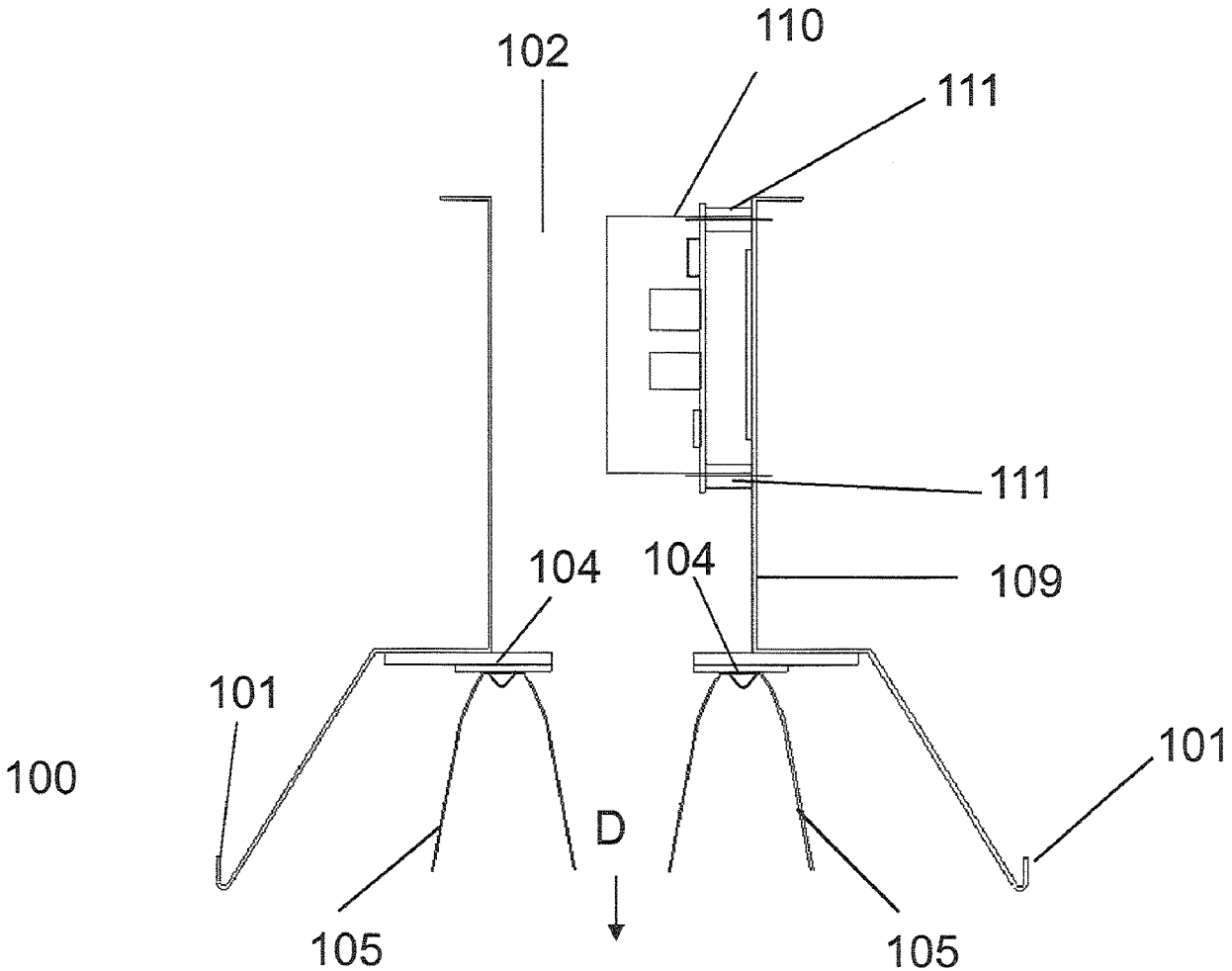
FIG. 7 shows a cross-sectional view of another variation of the invention that minimizes the amount of material used in the reflectors by allowing the use of a diffuser.

FIG. 7 shows a cross-sectional view of another variation of the invention that minimizes the amount of material used in the reflectors by allowing the use of a diffuser. Although FIG. 7 shows only the cross section, it is understood that the device 100 can have a length-wise, elongated shape similar to the device 1 shown in FIG. 2. Alternatively, the device 100 as well as the other variations discussed herein, can have one of a number of other shapes including a square, triangular or doughnut shape. The central opening 102 is shown in the center of the device 100. Unlike in FIGS. 1-6, FIG. 7 also includes a power supply 110 in the central opening 102. The power supply may be placed in any suitable location within the device, or it may be located outside of the device entirely. It is to be understood that power supply 110 may be placed in the central openings of any of the variations of the invention shown herein.

As shown in FIG. 7, LEDs 104 are mounted to the center of the reflectors 105. As with all of the other variations shown herein, the LEDs may be individual light units, or they may be part of a strip, cluster or band. Although not shown, generally wiring connects the LEDs 104 to the power supply 110. Power supply 110 may be spaced from the central body 109, such as by spacers 111. Reflectors 105 direct light from the LEDs toward the illuminated space. The Reflectors shown in FIG. 7 have a parabolic cross-sectional shape. Alternatively, the reflectors 105 can have one of a number of other suitable cross-sectional shapes, including v-shaped cross sections and c-shaped cross sections. Reflectors 105 shown on the device 100 are considerably smaller than those shown for the variations in FIGS. 1-6. The device 100 also includes hook members 101 for connecting a diffuser member (not shown).

Figure 8:
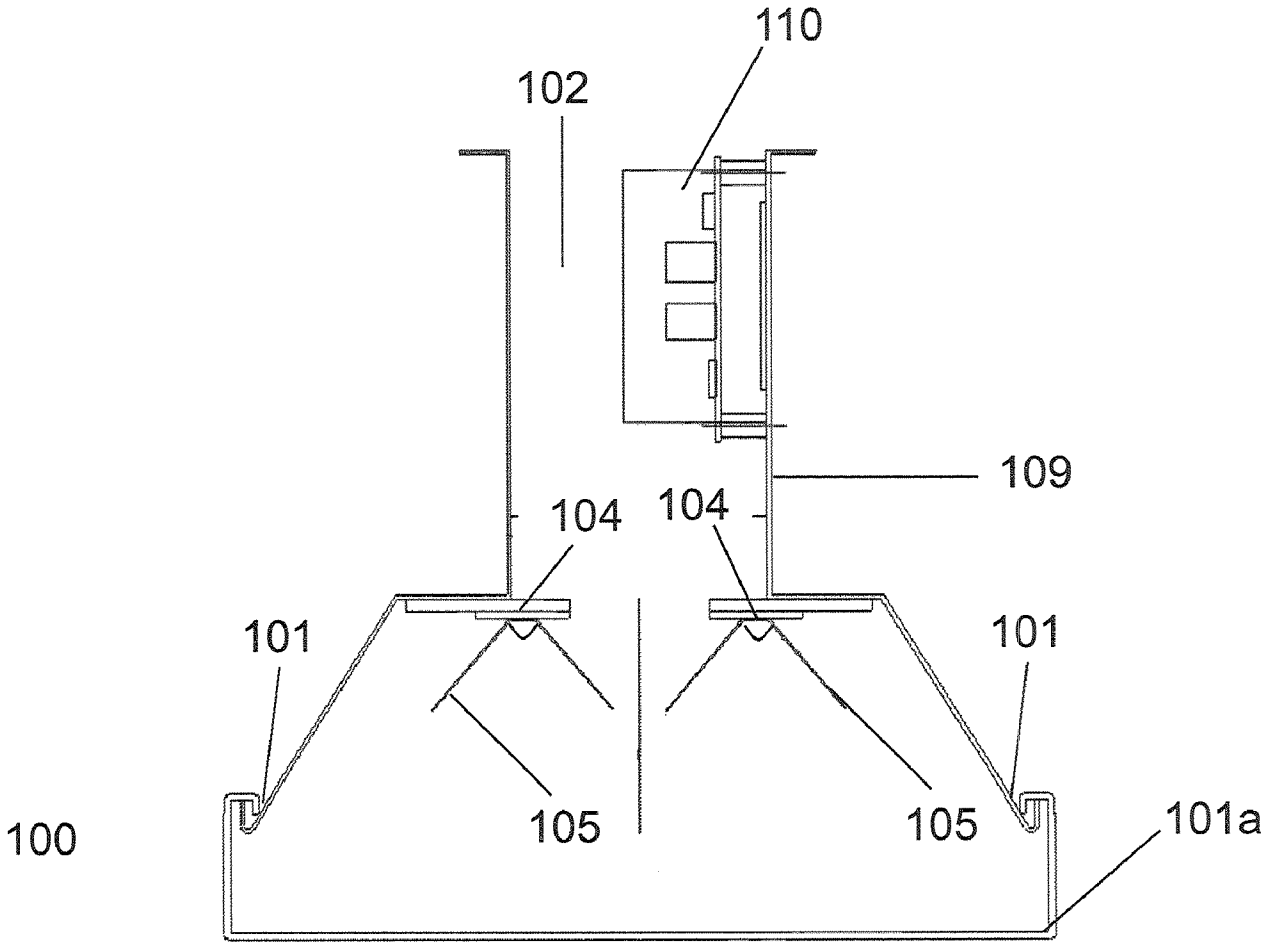
FIG. 8 shows the cross-sectional view of a variation of the device of FIG. 7 including a diffuser.

FIG. 8 shows the cross-sectional view of a variation of the device of FIG. 7 including a diffuser. The device 100 of FIG. 8 is identical to the device 100 of FIG. 7, apart from the fact that the reflectors 105 of FIG. 8 have a v-shaped cross section instead of the parabolic-shaped cross section of FIG. 7. The diffuser 101*a*, is shown as hung on the hooks 101. However, one of a number of mechanisms for hanging the diffuser are possible, including using clips, pins, buttons or snaps. The diffuser 101*a* once mounted to the device 100 spreads out light reflected downwardly from the reflectors 105.

The presence of the diffuser 101*a* allows the reflectors 105 of the device 100 to be considerably smaller than the reflectors shown in variations of the invention of FIG. 106. This is because the LEDs 104 of the variations shown in FIGS. 7 and 8 can be mounted substantially downward (i.e., toward the diffuser) thanks to the presence of the diffuser 101*a*. Mounting the LEDs 104 in the downward direction, as opposed to mounting them in a side-ways direction as sideways direction shown in FIG. 2, may increase the fraction of light intensity admitted by the LEDs 104 to the area to be illuminated. Although it would be possible in principle to mount LEDs in other variations herein in a downward direction, the brightness of the light emitted directly, in certain variations, may create an unpleasant effect when this is done without the diffuser element 101*a*. The diffuser 101*a* serves to spread out the high-intensity light profile emitted by downwardly facing LEDs 104. This, in turn, may minimize light loss and increase the operating efficiency of the device.

Further, using the diffuser 101*a* to allow downwardly facing LEDs 104 to illuminate a space, as shown in FIGS. 7 and 8, may minimize the amount of reflector needed in the device 100. A comparison of the device 100 shown in FIGS. 7 and 8 with other variations discussed herein immediately reveals that the reflectors 105 are much smaller, with respect to the LEDs 104 themselves, than are the reflectors of other variations. Since the reflectors 104 may be generally composed of potentially expensive components (as discussed above), minimizing their size is advantageous from the perspective of minimizing cost. Further, minimizing the size of the reflectors may also make it more economical to use more expensive and highly reflective material in the reflectors than otherwise would be economically possible.

A variation of the present invention provides lower power consumption and comparable if not better useful light production than fluorescent lights, also. A T-5, two tube fluorescent light provides 30 foot candles at a distance of 20 feet and consumes 120 Watts. In contrast, a variation of the present invention provides 35 foot candles at 20 feet and consumes only about 74 Watts.

Not only is the initial power consumption lowered, but the variations of the present invention have minimal heat production. As a result, additional air conditioning costs required by heat production from light fixtures are lowered.

In addition to lower heat production and lowered energy consumption, the lifetime of lighting is greatly increased with variations of the present invention. A typical T-5 fluorescent light has a maximum lifetime of about 20,000 hours. However, this number drops when a fluorescent light is turned on and off. The present invention has a minimum lifetime of 50,000 hours regardless of the number of times that the light is turned on and off. In an air conditioned setting, such as inside a warehouse, the lifetime of the present invention increases to between 50,000-200,000 hours based on location. This is because LEDs are not, in general, subject to embrittlement from repeatedly turning them on and off, as are more conventional lighting devices.

In addition, the ability to turn on and off without a decrease in lifetime makes the present invention more desirable for locations where the lights will be turned on and off frequently, such as in motion detection lighting applications.

LED lifetime may also be increased by a reduction in heat. Variations of the present invention have a number of features that reduce the amount of heat around the LEDs and may, therefore, result in increased LED lifetimes. First, the device may include a central chimney or heat sink that circulates air and removes heat from the area around the LEDs. This central chimney may include a central open portion between the two chimney sides pieces of the unit. The opening may be, for example, about 1-6 inches in width for a device that includes approximately 4 foot long chimney sides pieces. However, any suitable opening may be used. For example, the width may be approximately less than four inches. In an exemplary variation, the width may be approximately less than one inch.

In addition, each chimney side piece may include openings above each LED. For example, the openings may be approximately ⅛ by ¼ inch slots. These slots may increase air flow to and from the device as well as circulation around the LEDs. In addition, the device may be configured to be attached such that the chimney is spaced away from a ceiling or wall, and both ends of the device are open. All of these features increase the amount of air circulation and effectively lower the temperature around the LEDs. In addition or in alternative, a fan or other forced air circulation device may be used in any of the variations discussed herein to cool the area around the LEDs, and the above described temperature control features may be modified or removed.

In another variation, the chimney side piece may further include fins or a waffle effect on the top portion of the plate. For example, the fins or waffle effect may be provided on the top 1-2 inches of the side plate, above the portion where the reflector attaches to the chimney side piece. However, the fins may be provided in any suitable location and in any number in order to increase heat dissipation in the device.

A power supply and a driver may be provided in the central open portion between the two chimney side pieces. In addition, the power supply and driver may be attached to other locations. The power supply may be a constant current power supply that takes in between 85 to 265-277 and has a steady output of 36 V, 2.65 A, for example, for an illustrative application.

Additional power supplies may be used, as needed, in order to supply the number of LEDs used, or to supply other components of the device.

The present invention may used as a single unit. In addition, a plurality of units may be connected and used together to provide a greater amount of light.

Variations of the present invention include smaller versions that can be used for home lighting fixtures, desk lamps, etc. In these applications, the present invention consumes much less power than typical incandescent lights. For example, a typical incandescent light uses 65 Watts of power, whereas the present invention would use 8-10 Watts.

In addition, LEDs may provide additional safety benefits through the provision of no ultraviolet rays and by removing the risk of explosion of fluorescent bulbs.

Although the variations shown in FIGS. 1-8 show a rectangular shaped apparatus, a circular or other shaped apparatus may also be used. In a circular device, for example, the central chimney could include a hollow circular piece.

Figure 9:
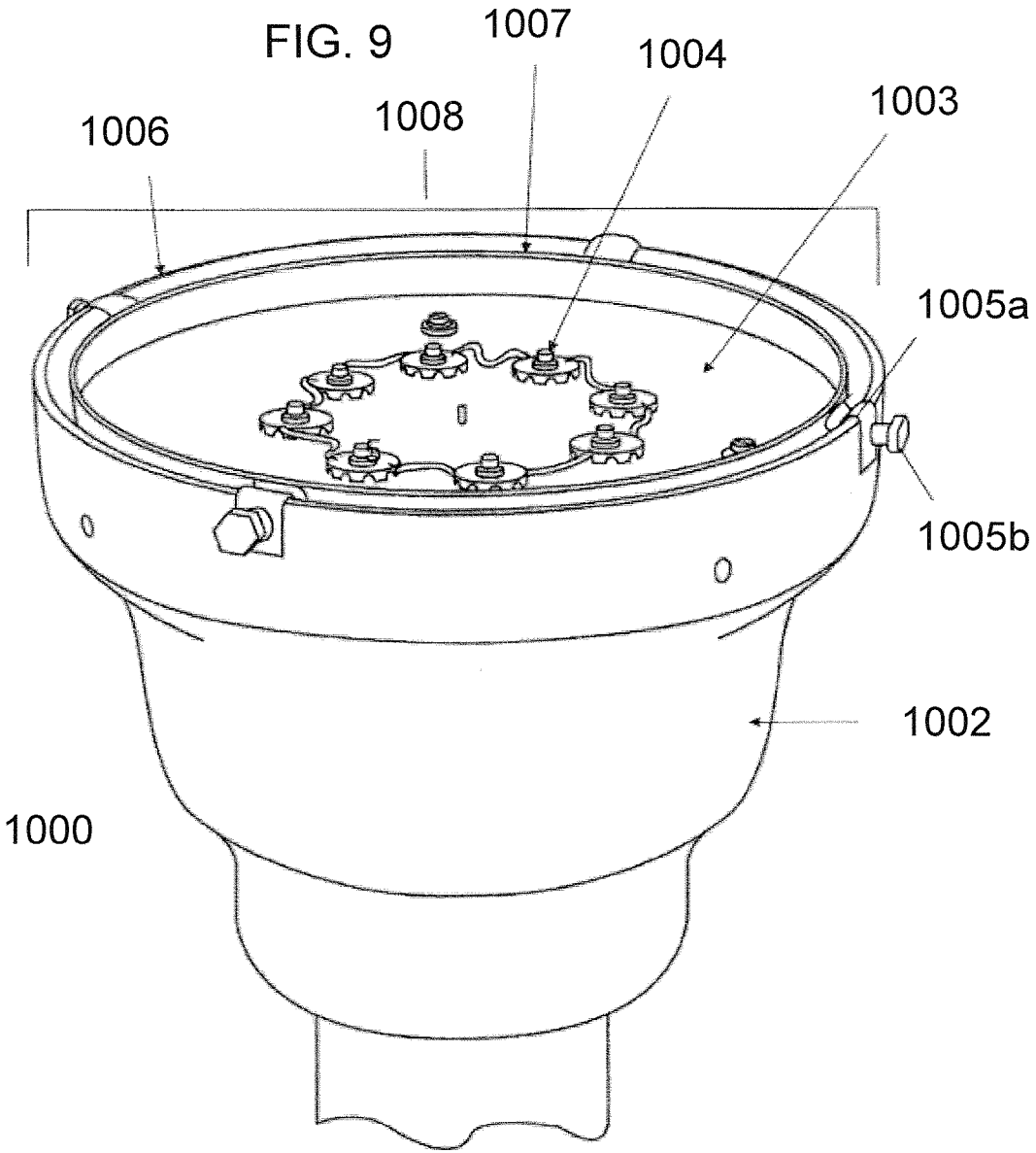
FIG. 9 shows an exemplary variation of a lamp device in accordance with aspects of the present invention.

Another exemplary variation of the device in accordance with aspects of the present invention is shown in FIG. 9. Here, as in subsequent figures, the orientation of the exemplary variation is generally shown inverted with respect to its typical operational orientation. However, any suitable operational orientation may be used. The inversion of FIG. 9 is done in order to show features of this variation of the invention. The variations shown in FIG. 9 includes a device 1000 with a circular cross-sectioned housing 1002, a circular or disk-shaped LED plate 1003 configured to fit within an opening 8 of the housing 1002 and having a plurality of LEDs 1004, an opening 1006 between the LED plate 1003 and the housing 1002, and at least one attachment piece 1005 that attaches the LED plate 1003 to the housing 1002. The opening 1006 between the housing 1002 and the LED plate 1003 allows water and dirt to drain out of the lamp housing 1002. In addition, this opening allows insects to leave the housing. The housing 1002 may be shaped in order to accommodate an incandescent light source. Alternatively, the housing 1002 can be shaped to accommodate any suitable light source, such as a florescent light source. The housing 1002 can have the shape with a circular cross section shown in FIG. 9. Alternatively, the housing may have one of a number of other suitable shapes for housing a light source and related components.

The exemplary variation illustrated in FIG. 9 also may include four attachment pieces 1005 attaching the LED plate 1003 to the housing 1002. However, two, three, or any other suitable number of attachment pieces may be used. These attachment pieces are illustrated as including a clip piece 1005*a* and an adjustment piece 1005*b*, such as a screw. However, other attachment pieces may be used, such as clips/bolts.

The variation of LED plate 1003 shown in FIG. 9 also includes an optional rolled edge 1007. This rolled edge may assist with heat dissipation. The rolled edge may be continuous as shown in FIG. 9. In addition, the rolled edge 1007 may include a plurality of slots 1010 as shown in the edge of the LED plate 1003 in FIG. 10 and again in the other variations of FIGS. 13 and 14.

Figure 10:
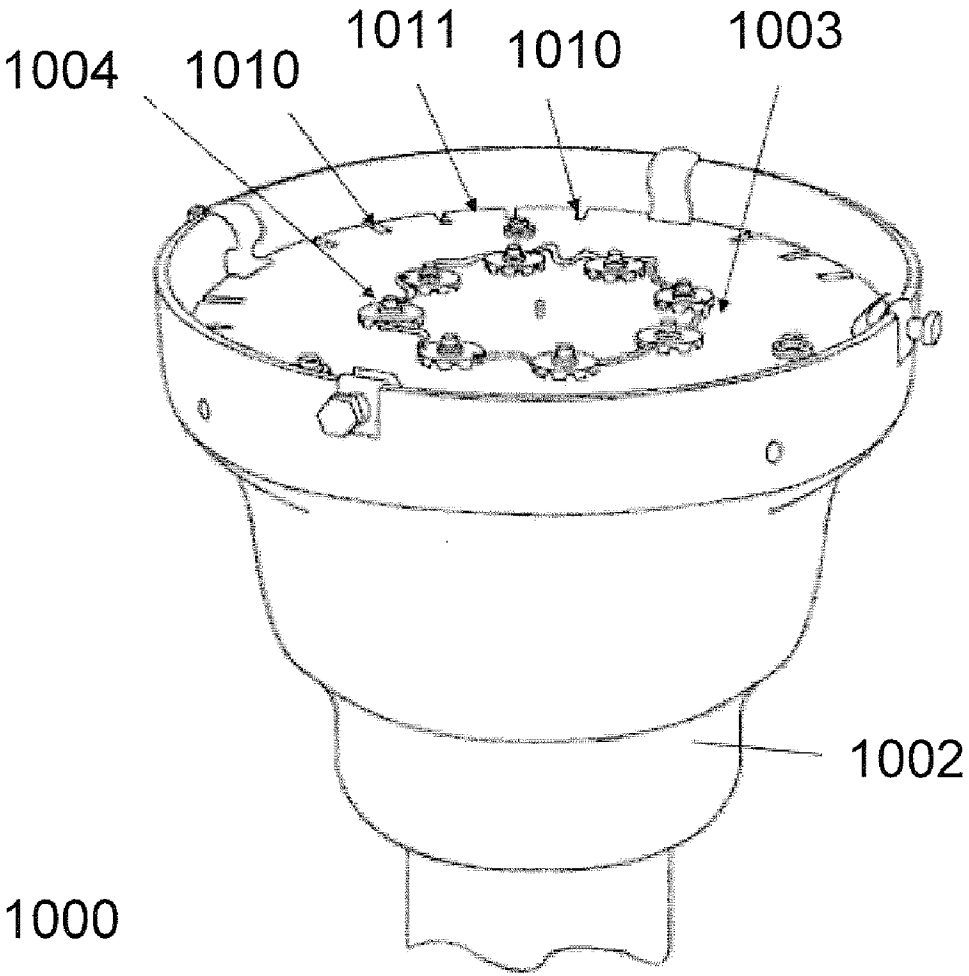
FIG. 10 shows another exemplary variation of a lamp device in accordance with aspects of the present invention.
Figure 11:
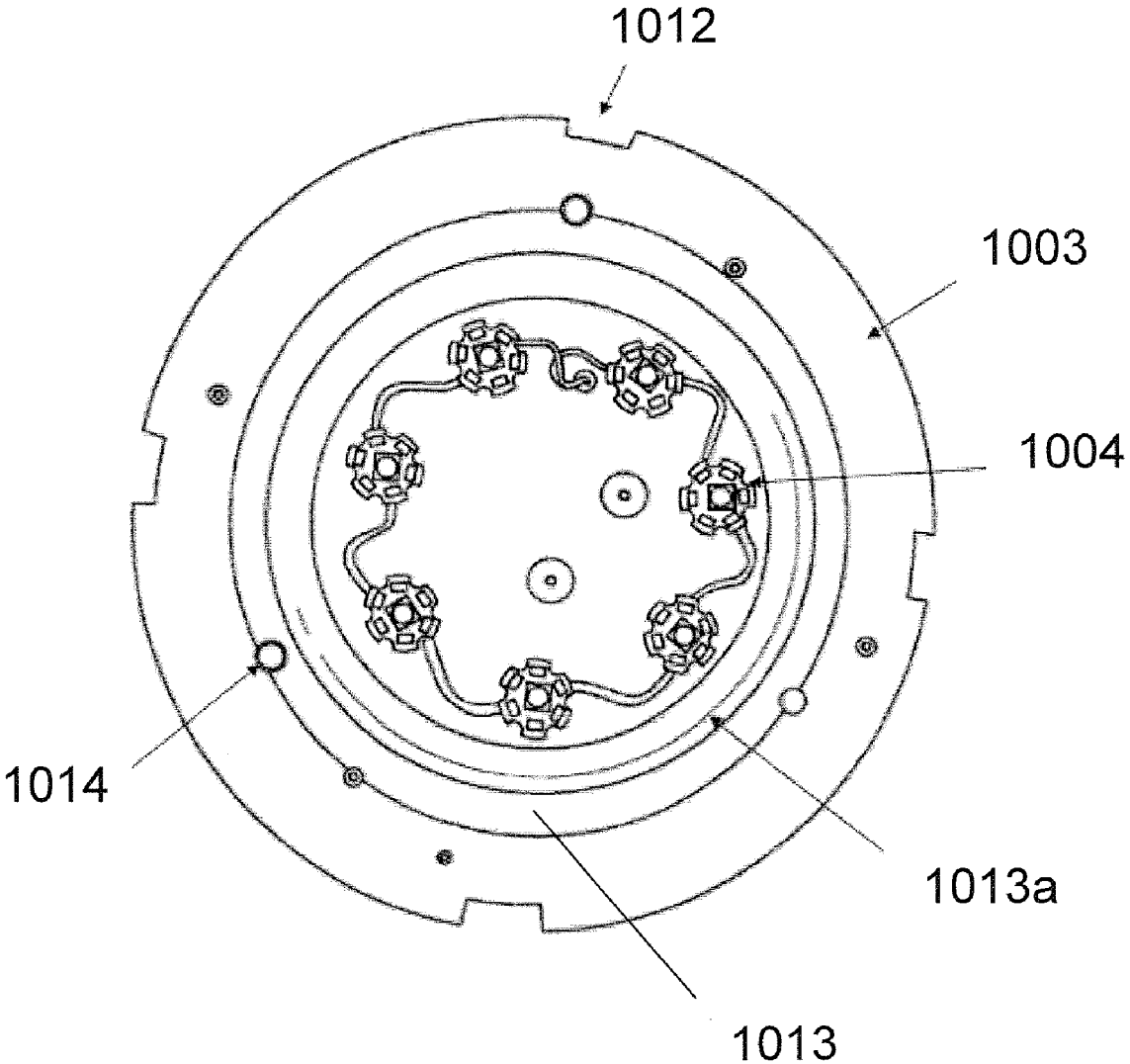
FIG. 11 shows an exemplary variation of an LED plate in accordance with aspects of the present invention.

In other variations, the LED plate may be formed without a rolled edge, as shown in FIGS. 10 and 11.

FIG. 10 shows another variation in accordance with aspects of the present invention. In this implementation, the LED plate does not have a rolled edge and includes a plurality of slots 1010. The slots 1010 in the LED plate 1003 allow for drainage of water or other materials that may accumulate inside the housing 1002 and for additional heat dissipation from the LEDs and other internal components inside the housing 1002. In addition, the slots 1010 may assist in attaching the LED plate 1003 to the opening in the housing 1002. The slots may allow the extension pieces 1011 on the LED plate to flex and bend to the unevenness of the lamp housing 1002. This may allow the plate to be pulled into and against the interior walls and top surfaces of the lamp housing 1002 by the attachment pieces.

Figure 13:
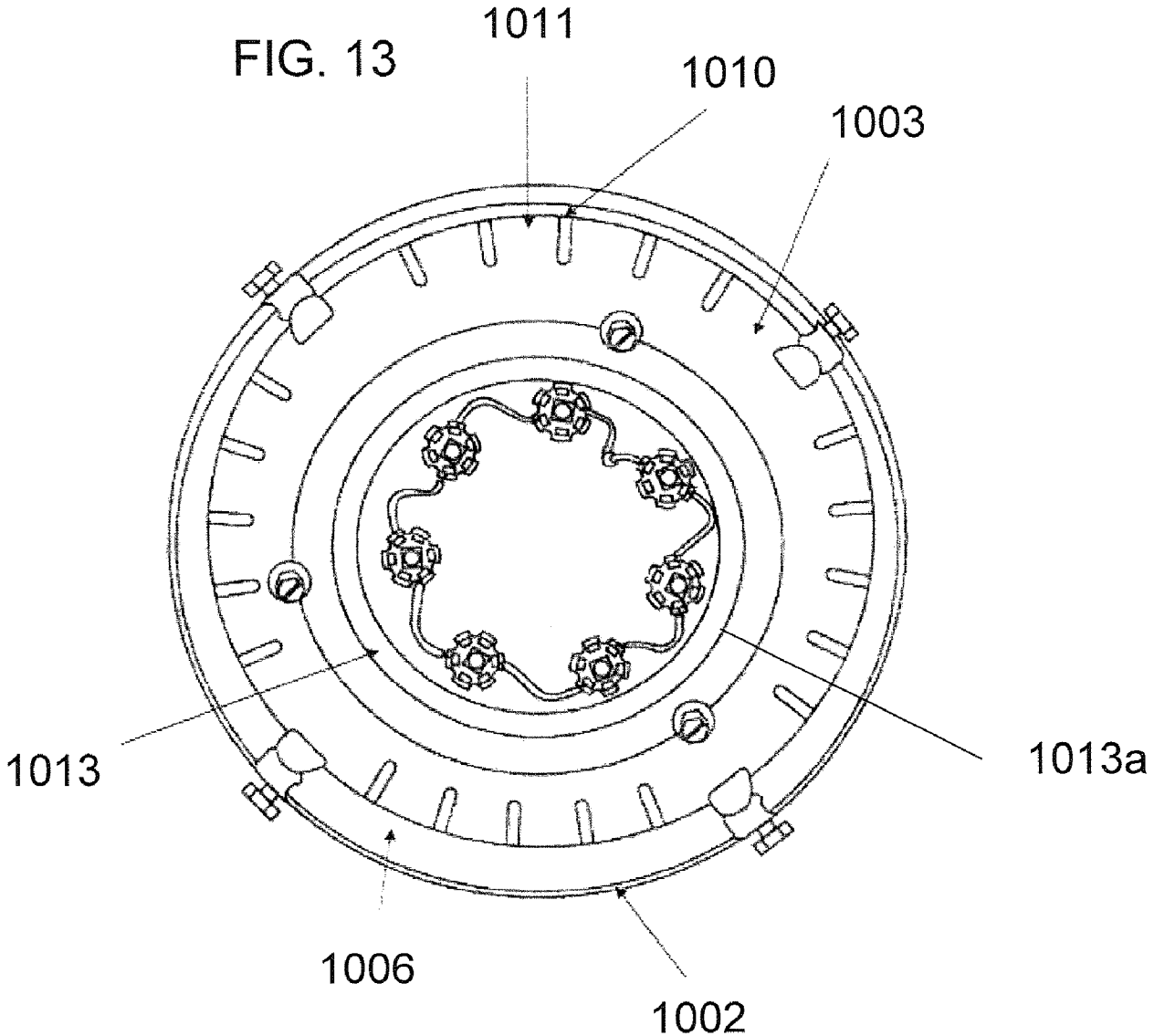
FIG. 13 shows another exemplary variation of a lamp device in accordance with aspects of the present invention.

In certain variations, the extension pieces 1011 of an LED plate abut the interior wall of the housing 1002, and the slots 1010 provide the opening 1006 between the LED plate 1003 and the housing 1002. In other variations, an additional space 1016 may be provided between the LED plate 1003 and the housing 1002, such as illustrated in FIG. 13.

FIG. 11 illustrates a variation of an LED plate in accordance with features of the present invention, the LED plate 1003 having a flat, unrolled and slotless edge. The LED plate includes notches 1012 at the positions at which the attachment pieces 1005 attach to the LED plate 1003. For example, the notches may allow attachment piece 1005*a* to clip to the LED plate 1003.

FIG. 11 also shows a cover plate 1013 attached to the LED plate 1003, surrounding the plurality of LEDs 1004. The cover plate 1013 may also have a breather valve 1013*a*, that allows ventilation of the interior of the device. Cover plate 1013 may be made of any clear or translucent protective material, such as, plexiglass, plastic, and/or glass. Among other things, cover plate 1013 prevents water, dirt, insects, and other contaminants from reaching the plurality of LEDs 1004. Cover plate 1013 may be attached to the LED plate 1003 using at least one attachment piece 1014. An attachment piece may include a screw, rivet, etc. In addition to an attachment piece, the cover plate 1013 may be attached to the LED plate using an adhesive or other type of adhesive substance and/or method.

Figure 12:
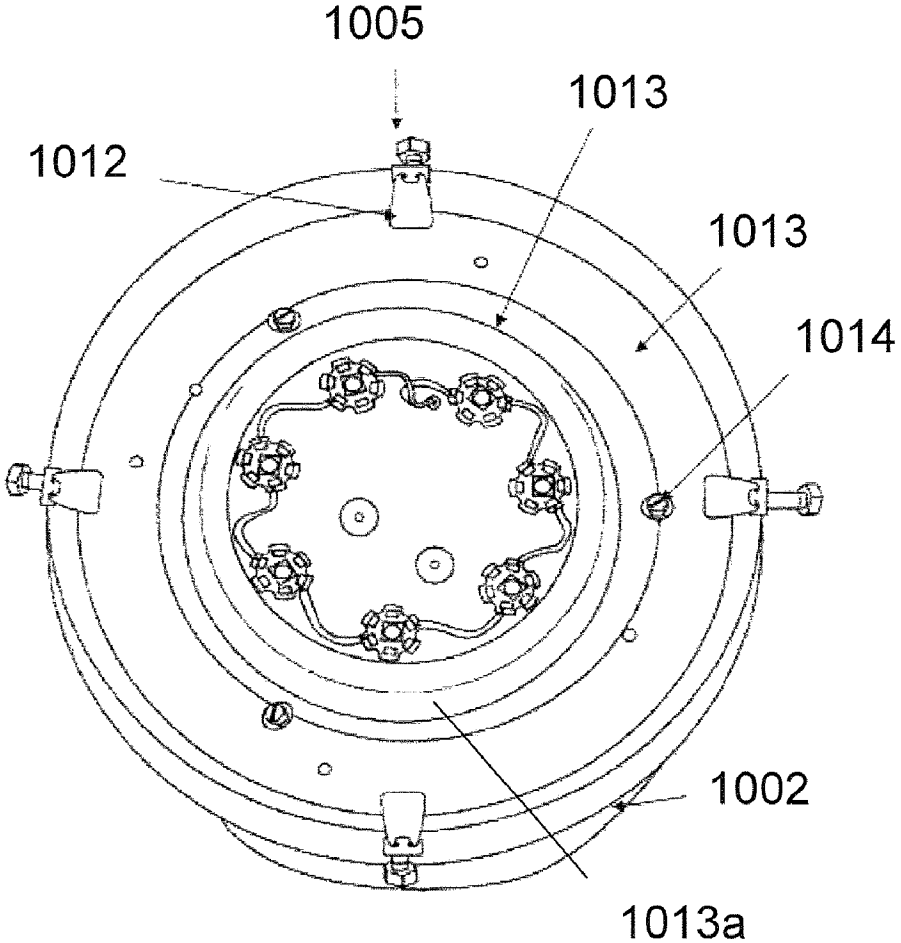
FIG. 12 shows another exemplary variation of a lamp device in accordance with aspects of the present invention.

The LED plate 1003 in FIG. 11 may be incorporated into a device having an opening between the LED plate 1003 and the housing 1002, and may also be incorporated into a device where the LED plate 1003 abuts the interior wall of the housing 1002. FIG. 12 shows a variation of the lamp device 1000, having an LED plate 1003 similar to the variation shown in FIG. 11, but wherein the outer edge of the LED plate 1003 abuts the interior wall of the housing 1002.

FIG. 13 shows a variation of the device that combines certain aspects of the variations of FIGS. 12 and 10, among others. For example, FIG. 12 shows the use of a cover plate 1013 and breather valve 1013*a* in addition to a plurality of slots 1010 on the edge of the LED plate 1003. In generally, it is possible to combine each of the aspects discussed herein with each of the other aspects discussed herein as suitable for a particular application. In this case, providing these two aspects in a single device increases the ventilation of the device.

Figure 14:
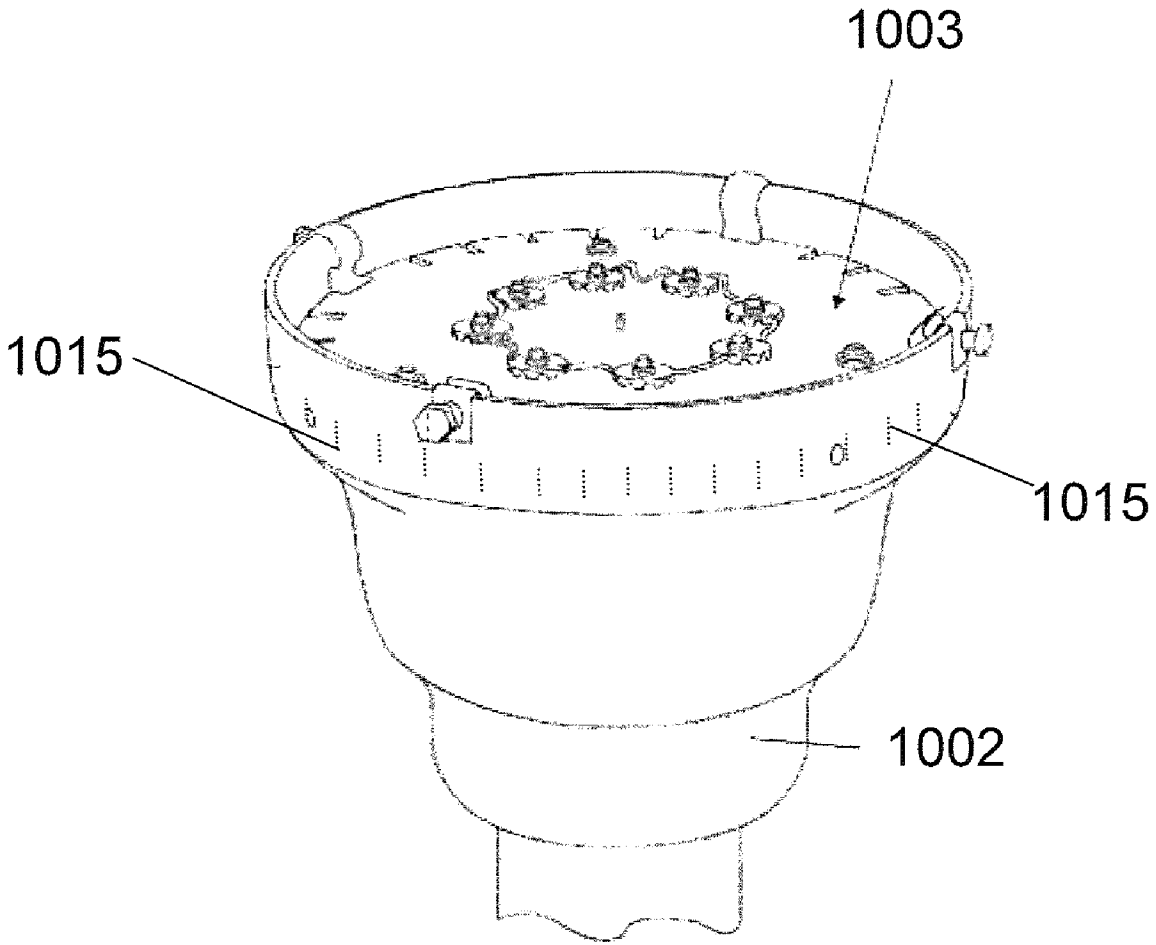
FIG. 14 shows a view of shows another exemplary variation of a lamp device in accordance with aspects of the present invention, the variation including internal cooling fins.
Figure 15:
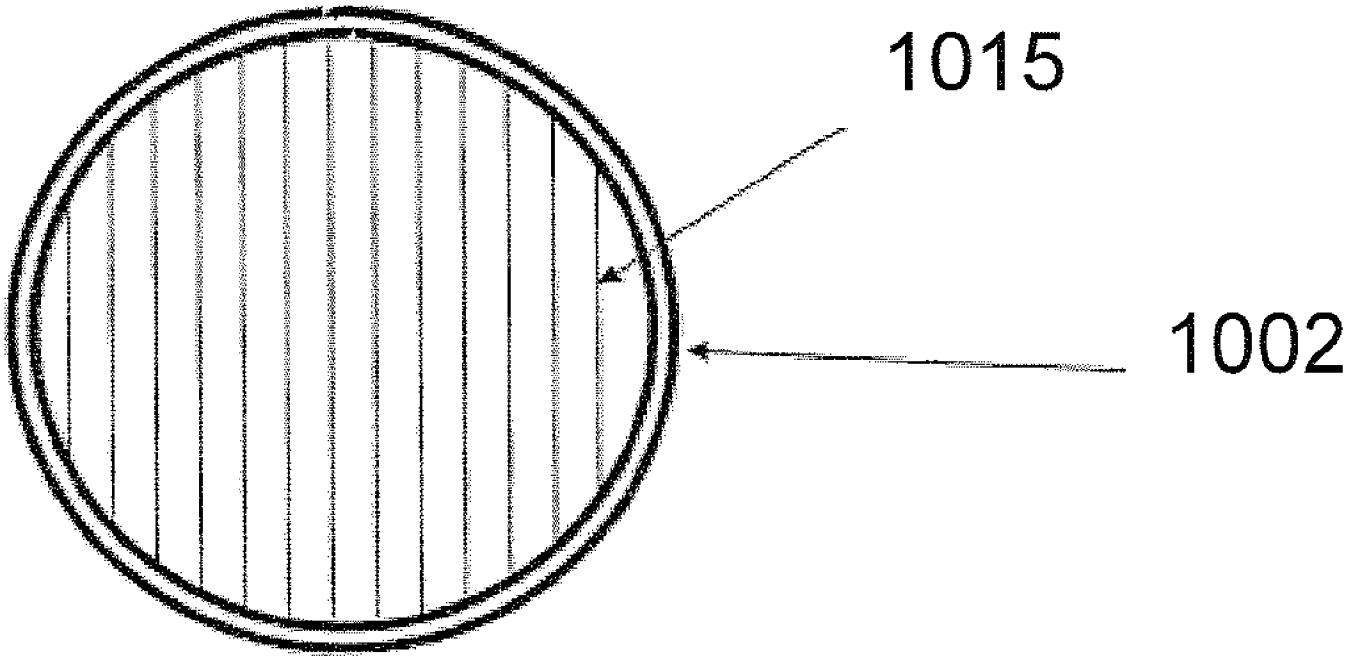
FIG. 15 shows a view of the cooling fins in the exemplary variation in FIG. 14, with the LED plate removed.

In certain variations, the lamp may further include a plurality of fins 1015 located inside the housing 1002, such as behind the LED plate 1003, as shown in FIG. 14. The fins 1015 are represented as dotted lines in FIG. 14 because they are placed within the device and are not visible from its exterior. In other words, the dotted lines indicated the interior placement of the fins 1015 in the device. Among other things, these fins provide for additional heat dissipation from the LED plate. FIG. 15 shows a view of the fins 1015 in the housing 1002, with the LED plate 1003 removed. The fins 1015 may be welded or attached directly to the LED plate 1003 on the side opposite the plurality of LEDs 1004. The fins may be between ½ inch and 4 inches tall, with a spacing of less than 1 inch between adjacent fins. For example, the fins may be about ½ inch tall with a spacing of about ¾ inches, or the fins may be up to about 4 inches tall with a spacing of about ¾ inches. However, fins of any suitable size, shape or spacing may be used.

The cooling fins 1015 may be especially helpful if the housing is made of a material other than metal. In certain variations with non-metal housing, heat dissipation may not substantially occur through the walls of the housing. Since LED lifetime is generally inversely related to the ambient temperature of operation, lifetime may be improved by fins that increase air flow to and from the device, as well as enhance circulation of an around the LEDs. This airflow may increase the amount of air circulation and effectively lower the temperature around the LEDs. In an alternative variation, a fan or other forced air circulation device may be used to cool the area around the LEDs, and the above described temperature control features may be modified or removed.

Figure 16:
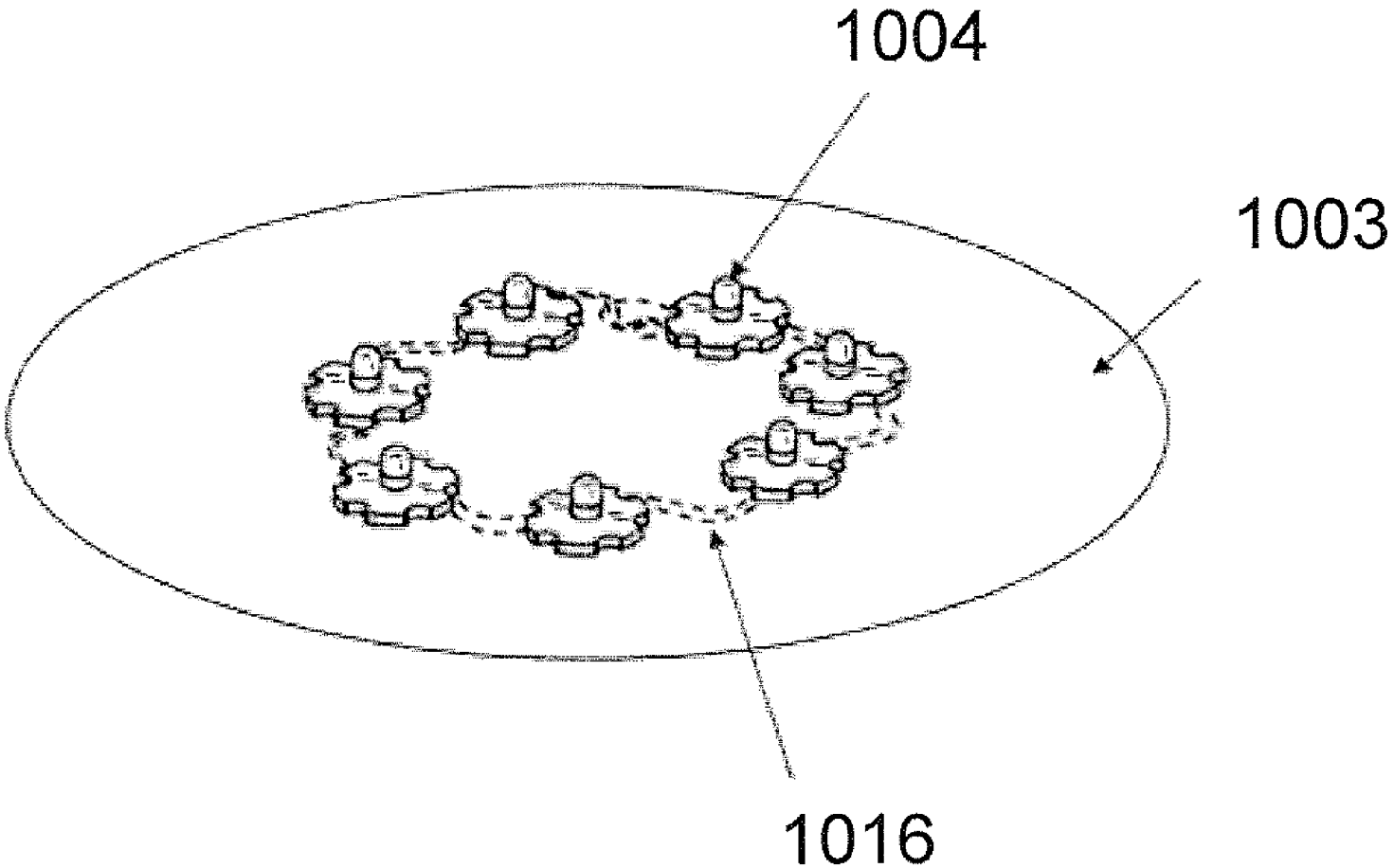
FIG. 16 illustrates an exemplary variation of the LED placement in accordance with aspects of the present invention.
Figure 17:
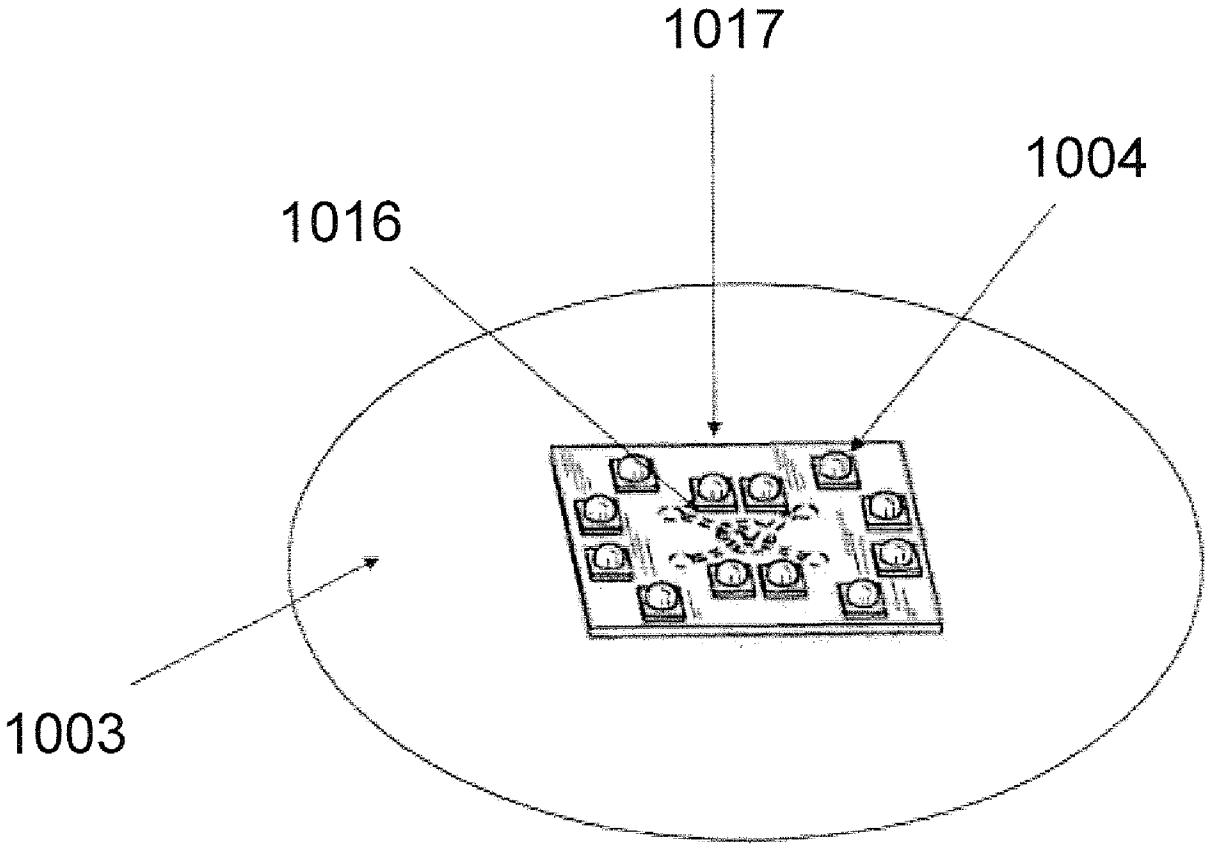
FIG. 17 illustrates another exemplary variation of the LED placement in accordance with aspects of the present invention.

The plurality of LEDs may be configured in a plurality of designs, such as a rounded or linear pattern, and may come pre-attached to a single LED piece. FIG. 16 illustrates an exemplary rounded pattern of LEDs 1004 having wiring 1016 located on the side of the LED plate 1003 opposite the side through which the LEDs 1004 protrude. FIG. 17 illustrates an exemplary linear pattern of LEDs 1004. FIG. 17 also illustrates the plurality of LEDs 1004 attached to a separate LED piece 1017. This variation allows pre-made LED pieces 1017 to be quickly attached to an LED plate and placed in a housing 1002, thereby, making the mass manufacture of the LED lamp device more efficient.

Aspects of the present invention include a method of retrofitting preexisting lamps to include features in accordance with variations of the LED lamp in accordance with aspects of the present invention. Among other things, the method of retrofitting a preexisting lamp may include removing a preexisting lamp from a pole or other lamp attachment mechanism and removing the internal components of the lamp. These internal components may include the igniter, transformer, and/or capacitor. Then, any extension pieces or bosses on the preexisting lamp may be ground down or otherwise removed. In an alternative method, the entire top portion of the lamp may be removed. An LED plate according to aspects of the present invention may be provided, a lubricant, such as thermal grease, may be applied to the lamp, and the LED plate may be attached via at least one attachment piece. The LED plate includes the plurality of LEDs 1004, and wiring 1016 for connecting the LEDs to a power source. The wiring is connected to the lamp, and the lamp may be replaced on the pole or lamp attachment mechanism.

As discussed above, the method may include attaching the LED plate to the lamp housing in such a manner that the exterior of the LED plate is pulled against the interior of the housing. The method may further include attaching cooling fins and a cover plate to the LED plate.

This method in accordance with aspects of the present invention allows the removal of a less efficient light source in a preexisting lamp housing and replacement with an LED plate. Among other things, the simplicity of aspects of this method allows for efficient mass manufacture and retrofitting of existing lamps.

Aspects of the present invention provide light with lower power consumption than typical incandescent or metal halide lights. Existing metal halide lights or high pressure sodium lamps use between 100-175 watts of energy. In contrast, an exemplary implementation in accordance with aspects of the present invention uses only between 15-70 watts, while outputting the same amount, if not more, light than the typical metal halide lamp. For example, previous 100-175 watt metal halide lamps may produce less than 2000 lumens of light. For example, a 100 watt metal halide lamp may produce about 1140 lumens. A large apparatus in accordance with aspects of the present invention may output between 3,000-4,000 lumens.

The power usage and lumen output of the LED lamp according to aspects of the present invention depends on the number of LEDs used in the lamp. The lamp may include between 12-24 LEDs. For example, 24 LEDs may be used to replace a 175 Watt metal halide lamp. The 175 Watt lamp would output less than 2000 lumens. In contrast, the 24 LED variation of the present invention would output up to 4,000 lumens and use only 70 Watts of power.

Fewer LEDs may be used to replace a 75 Watt lamp. Some implementations of the present invention may require only approximately 15 Watts of power or less.

The light output from an LED lamp in accordance with aspects of the present invention will be a white light, rather than the yellow light output by previous lamps.

Not only is the initial power consumption lowered, but aspects of the present invention include features for minimizing heat production. As a result, among other things, additional air conditioning costs required by heat production from light fixtures are lowered.

In addition to lower heat production and lowered energy consumption, the lifetime of lighting may be substantially increased with some variations of the present invention. Typical fluorescent lights have a maximum lifetime that drops when the fluorescent light is turned on and off. Some variations of the present invention have a minimum lifetime of about 8000 hours, regardless of the number of times that the light is turned on and off. In an air conditioned setting, such as typically exists inside a warehouse, the lifetime of 8000 hrs in accordance with aspects of the present invention increases to between about 60,000 and 300,000 hours, depending on location.

In addition, the ability to turn on and off without a decrease in lifetime makes such variations of the present invention more desirable for locations where the lights will be turned on and off frequently, such as in motion detection lighting applications.

In some variations, a power supply and a driver may be provided inside the housing. In addition, the power supply and driver may be attached to other locations. The power supply may be a constant current power supply that takes in about 1 amp at 120 volts AC and has a steady output of 36 volts DC 1.2 Amps, for example, for an illustrative application.

Additional power supplies may be used, as needed, in order to supply the number of LEDs used.

Devices in accordance with aspects of the present invention may used as a single unit. In addition, a plurality of units may be connected and used together to provide a greater amount of light.

Variations of the present invention may include smaller versions that can be used for home lighting fixtures, desk lamps, etc. In these applications, the devices may consume much less power than typical incandescent lights. For example, a typical incandescent light may use 65 Watts of power, whereas a device in accordance with aspects of the present invention may use 8-10 Watts.

In addition, LEDs may provide additional safety benefits through the provision of no ultraviolet rays and by removing the risk of explosion of fluorescent bulbs.

Example aspects of the present invention have now been described in accordance with the above advantages. It will be appreciated that these examples are merely illustrative thereof. Many variations and modifications will be apparent to those skilled in the art.

The invention claimed is:

1. An illumination device for providing light in an illumination direction, the illumination device comprising:

a central body having a surface facing the illumination direction;

a group of Light Emitting Diodes (LEDs) connected to the central body, wherein the LEDs are oriented in the illumination direction; and a reflector extending from the central body adjacent to the group of LEDs for directing light from the group of LEDs in the illumination direction, wherein the reflector comprises a first side and a separate second side opposing the first side, each side extending substantially along a longitudinal axis of the illumination device, and wherein the central body comprises a projecting hook portion extending substantially parallel to the reflector.

2. The illumination device of claim 1, further comprising:

a plurality of groups of LEDs; and a plurality of reflectors, each reflector corresponding to at least one group of LEDs.

3. The illumination device of claim 1, wherein the light from each LED is emitted in a direction substantially parallel to the illumination direction.

4. The illumination device of claim 1, wherein the reflector is shaped for directing light from the group of LEDs in the illumination direction.

5. The illumination device of claim 4, wherein the reflector includes one selected from a group consisting of a curve, a parabola, an angle, a facet, and a plurality of facets.

6. The illumination device of claim 1, wherein the central body includes an opening for allowing a cooling fluid to flow through a central portion of the central body.

7. The illumination device of claim 6, wherein the cooling fluid is air.

8. The illumination device of claim 6, wherein the opening includes a portion configured as a chimney for convectively circulating air and removing heat in a generally single direction.

9. The illumination device of claim 8, wherein the chimney comprises a shape selected from a group consisting of a rectangle, a square, a triangle, and a circle.

10. The illumination device of claim 8, wherein the group of LEDs are disposed at least partially along a travel path of the convectively circulating air.

11. The illumination device of claim 6, wherein the central body comprises a heat conducting material.

12. The illumination device of claim 6, further comprising:

a power supply provided in the opening of the central body.

13. The illumination device of claim 1, wherein the central body comprises a heat conducting material.

14. The illumination device of claim 13, wherein the central body comprises a metal.

15. The illumination device of claim 13, wherein the central body comprises aluminum.

16. The illumination device of claim 1, wherein the central body comprises at least one opening adjacent to an LED.

17. The illumination device of claim 1, wherein the reflector comprises at least one opening adjacent to an LED.

18. The illumination device of claim 1, further comprising:

a plurality of reflectors, wherein at least two reflectors are provided proximal to the group of LEDs on opposite sides of the group of LEDs.

19. The illumination device of claim 18, wherein the reflectors are adjacent to each other.

20. The illumination device of claim 1, further comprising:

a diffuser coupleable to the projecting hook portion for spreading light.

* * * * *